US007827830B2

(12) United States Patent
Kim

(10) Patent No.: US 7,827,830 B2
(45) Date of Patent: Nov. 9, 2010

(54) WASHING MACHINE HAVING FILTERING LIFTERS

(75) Inventor: Chang Hoo Kim, Incheon (KR)

(73) Assignee: Daewoo Electronics Corporation, Seoul (KR)

( * ) Notice: Subject to any disclaimer, the term of this patent is extended or adjusted under 35 U.S.C. 154(b) by 328 days.

(21) Appl. No.: 11/964,348

(22) Filed: Dec. 26, 2007

(65) Prior Publication Data

US 2008/0282747 A1 Nov. 20, 2008

(30) Foreign Application Priority Data

May 14, 2007 (KR) ..... 10-2007-0046370

(51) Int. Cl.
*D06F 29/00* (2006.01)

(52) U.S. Cl. ..... 68/13 R

(58) Field of Classification Search ..... 68/13 R
See application file for complete search history.

(56) References Cited

U.S. PATENT DOCUMENTS 4,971,449 A * 11/1990 Hendren ..... 366/228
2005/0097927 A1* 5/2005 Kim et al. ..... 68/24
2005/0252253 A1* 11/2005 Ahn ..... 68/142

FOREIGN PATENT DOCUMENTS

JP 2004089339 * 2/2004
WO WO2005/118940 * 12/2005
WO WO2007/124804 * 11/2007

OTHER PUBLICATIONS

Machine translation of JP2004-089339.*
Machine translation of JP2004-089339 (Feb. 2004).*

* cited by examiner

*Primary Examiner*—Michael Cleveland
*Assistant Examiner*—Samuel A Waldbaum
(74) *Attorney, Agent, or Firm*—Occhiuti Rohlicek & Tsao LLP

(57) ABSTRACT

Disclosed herein is a washing machine that includes a lifter capable of removing foreign matter from water while agitating laundry. The washing machine includes a tub containing water supplied from an outside source, a drum disposed inside the tub, a lifter body mounted to the drum; a filtering unit disposed in the lifter body to collect foreign matter from wash water as it circulates within the machine, and a water supply part guiding the water being introduced from the tub to the filtering unit of the lifter

10 Claims, 9 Drawing Sheets

WASHING MACHINE HAVING FILTERING LIFTERS

CROSS-REFERENCE TO RELATED APPLICATION

The present application claims priority to Korean patent application number 10-2007-0046370, filed on May 14, 2007, which is incorporated by reference in its entirety.

BACKGROUND OF THE INVENTION

1. Field of the Invention

The present invention relates to a lifter, and more particularly to a washing machine that includes a lifter capable of removing and discharging foreign matter from water while agitating laundry.

2. Description of the Related Art

As illustrated in FIG. 1, a conventional front-loading type washing machine is known to include lifters formed on an inner surface of the drum to lift and drop laundry within the drum during a rotation of the drum.

For example, the conventional washing machine includes a cabinet 2, an opening 1 formed at a front side of the cabinet 2, and a tub 4 disposed inside the opening 1 and configured to contain water supplied from the outside. In addition, a drum 3 is rotatably mounted in the tub 4 and configured to receive laundry and detergent, a motor 6 is connected to a rotational shaft of the drum 3 and mounted behind the tub 4, and a suspension 8 is disposed between an inner wall of the cabinet 2 and an outer wall of the tub 4 to allow the tub 4 to move in a certain range inside the cabinet 2.

The drum 3 is arranged to open in the same direction as the cabinet 2 and the tub 4, and a horizontally disposed rotational shaft 7 of the motor 6 is mounted to a rear outer wall of the drum 3. Here, the shaft 7 of the motor 6 is provided at one end with a tripod-shaped spider 9, which is fastened to the rear outer wall of the drum 3.

When the motor 6 is operated, the drum 3 is driven to rotate around the horizontal shaft 7 to perform a washing operation.

The drum 3 includes a plurality of lifters 5 that protrude from an inner wall of the drum 3 toward the center of rotation to raise and drop laundry during rotation of the drum 3, thereby increasing agitation of the laundry and improving the washing effect of the washing machine.

Each of the lifters 5 is horizontally elongated on the inner wall of the drum 3 and protrudes toward the center of rotation such that laundry can be raised by the lifters 5 within the drum 3 during the rotation of the drum 3, thereby increasing the agitation of the laundry.

In the conventional washing machine, however, the lifters 5 provide a simple function of increasing the agitation of the laundry. However, if the laundry includes a great amount of foreign matter, there is a problem in that some of foreign matter cannot be completely removed from the laundry and remain therein even after the washing operation.

In this regard, it should be noted that the above description is illustrated only for understanding the background of the invention and does not form a conventional technique that is well-known to those skilled in the art.

SUMMARY OF THE INVENTION

The present invention is conceived to solve the problems of the conventional techniques as described above, and an aspect of the present invention is to provide a washing machine that includes a lifter capable of collecting foreign matter from wash water as it circulates within the washing machine.

Another aspect of the present invention is to provide a washing machine to which a lifter capable of collecting foreign matter can be easily mounted.

A further aspect of the present invention is to provide a washing machine that includes a lifter capable of preventing foreign matter collected from water from being discharged again into a drum.

Yet another aspect of the present invention is to provide a washing machine that includes a lifter capable of easily collecting foreign matter from water and having a high capacity in collection of such foreign matter.

In accordance with one aspect of the present invention, a washing machine includes: a tub; a drum disposed inside the tub; a lifter body mounted to the drum; a filtering unit disposed in the lifter body to collect foreign matter; and a water supply part guiding the water being introduced from the tub to the filtering unit.

The drum may include a latch hole into which the lifter body is fitted, and a coupling hole to which the lifter body is coupled. The lifter body may be opened at one side, and may include a securing protrusion to be inserted into the latch hole, and a fastening hole to be fastened to the coupling hole.

The lifter body may include a seating part on which the filtering unit is seated, and the seating part may include a groove and a through-hole into which water is introduced. The lifter body may further include a partition wall dividing an interior thereof. The washing machine may further include a guide between the lifter body and the partition wall. The guide may protrude from an inner wall of the lifter body toward the partition wall and be bent in a curved shape toward the through-hole. The water supply part may include: a hole formed in the drum corresponding to the through-hole; and a guide panel obliquely extending from the hole to an outside of the drum. The water supply part may include: a hole; and a guide panel obliquely extending from the hole.

The filtering unit may further include a latch part. The filtering unit may include: a case having an inlet; a cover hingedly coupled to the case and having an outlet; a filter mounted inside the outlet; and a locking part disposed between the case and the cover. The latch part may include a protrusion on the case.

The filtering unit may be detachably mounted to the lifter body.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE INVENTION

Exemplary embodiments of the present invention will be described in detail with reference to the accompanying drawings. For descriptive convenience, the present invention will be described based on a drum type washing machine. The drawings are not to precise scale and may be exaggerated in thickness of lines or size of components for descriptive convenience and clarity only. Furthermore, terms used herein should be defined in consideration of functions of components of the present invention and thus can be changed according to the custom or intention of users or operators. Therefore, definition of such terms should be determined according to overall disclosures set forth herein.

Figure 1:
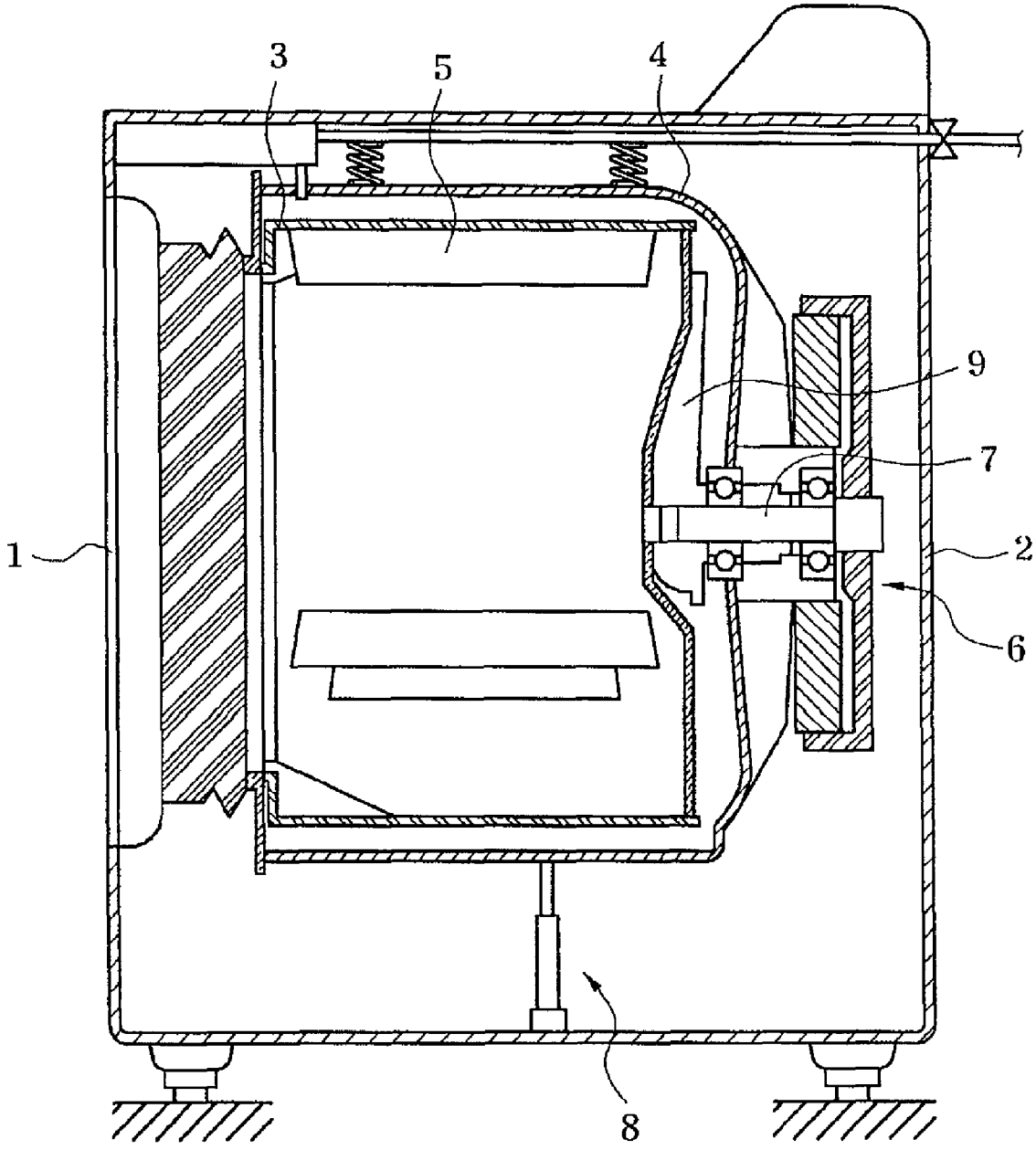
FIG. 1 PRIOR ART
FIG. 1 is a side-sectional view of a conventional washing machine.
Figure 2:
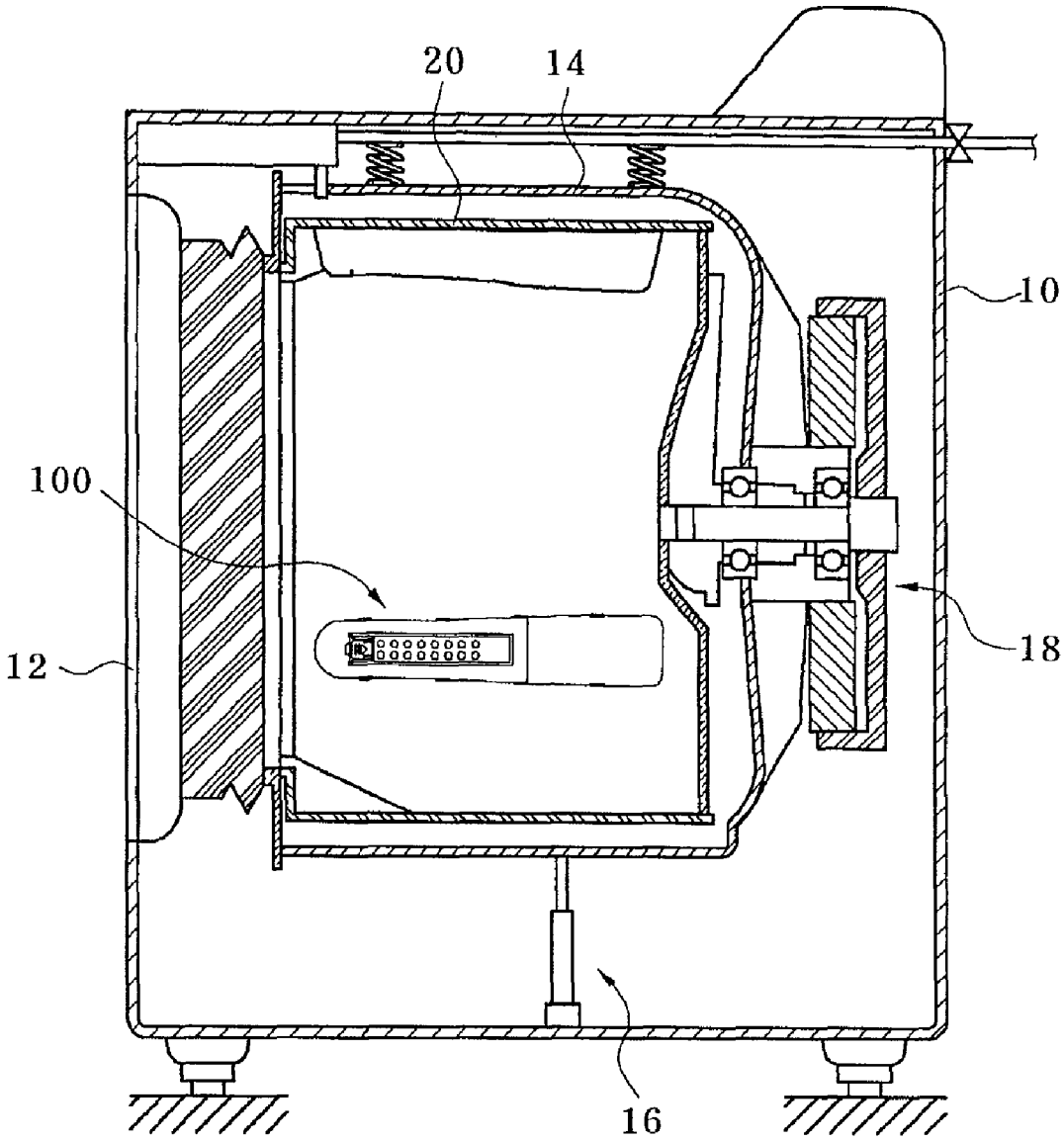
FIG. 2 is a side-sectional view of a washing machine according to one embodiment of the present invention.
Figure 3:
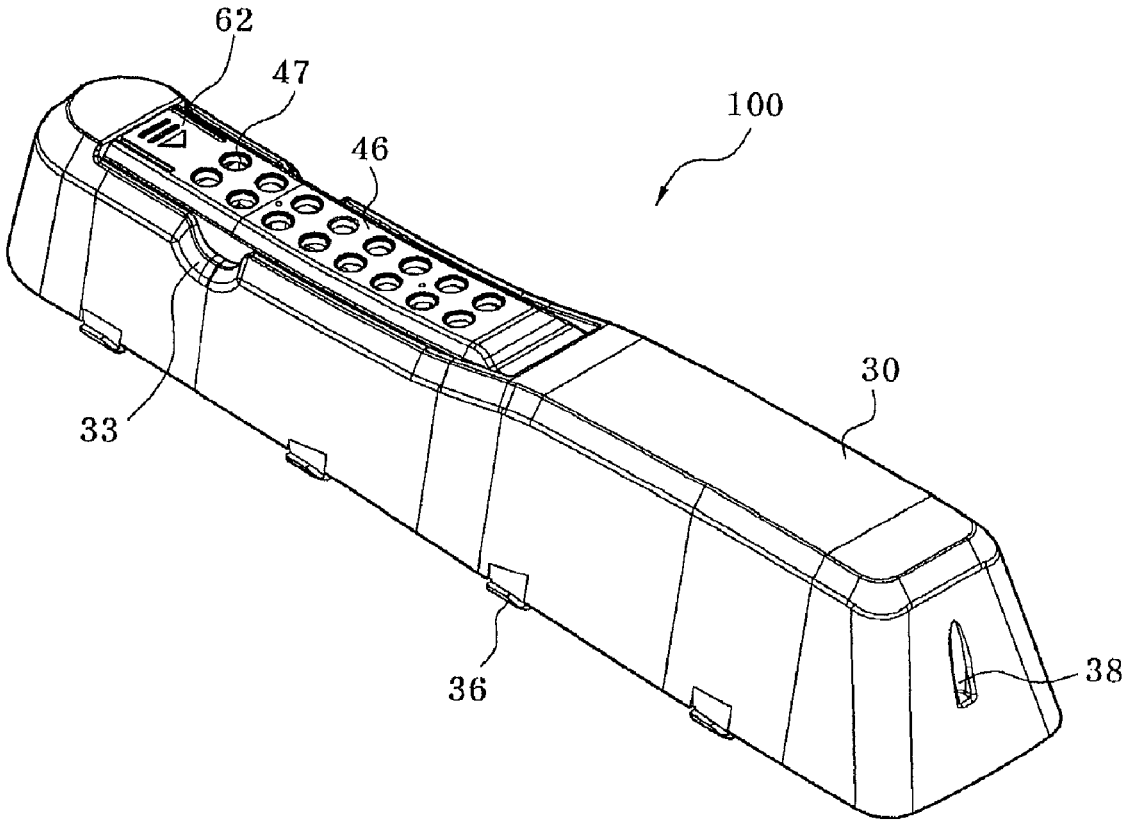
FIG. 3 is a perspective view of a lifter of the washing machine according to one embodiment of the present invention.
Figure 4:
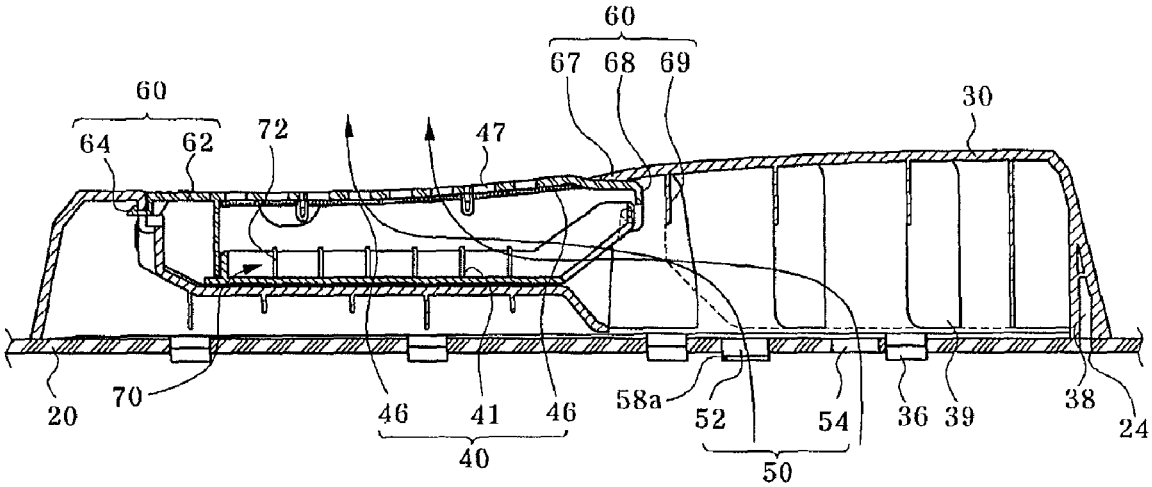
FIG. 4 is a cross-sectional view of the lifter of the washing machine according to one embodiment of the present invention.
Figure 5:
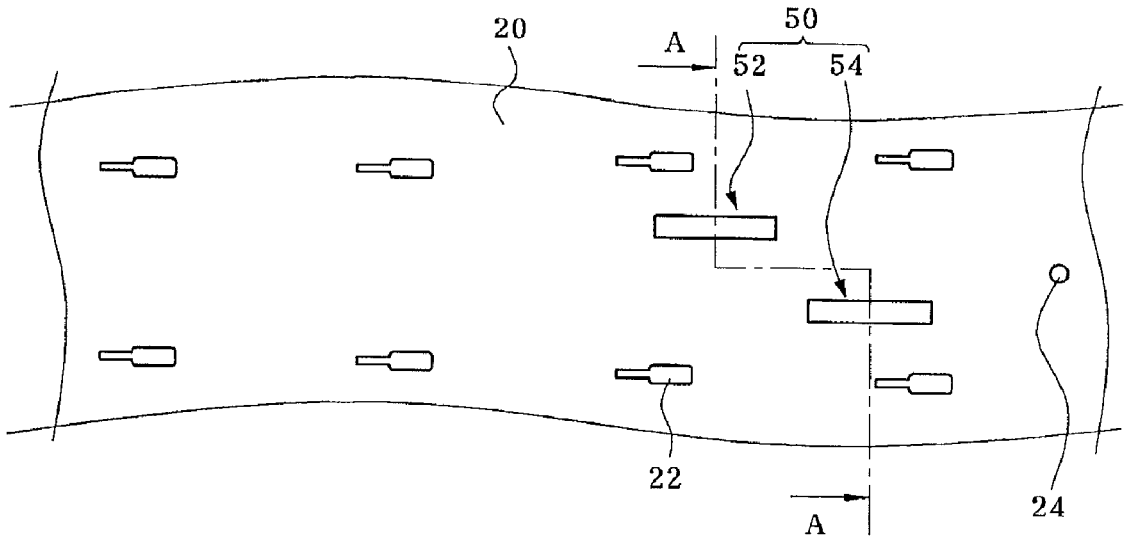
FIG. 5 is a plan view of an inner wall of a drum in the washing machine according to one embodiment of the present invention.
Figure 6:
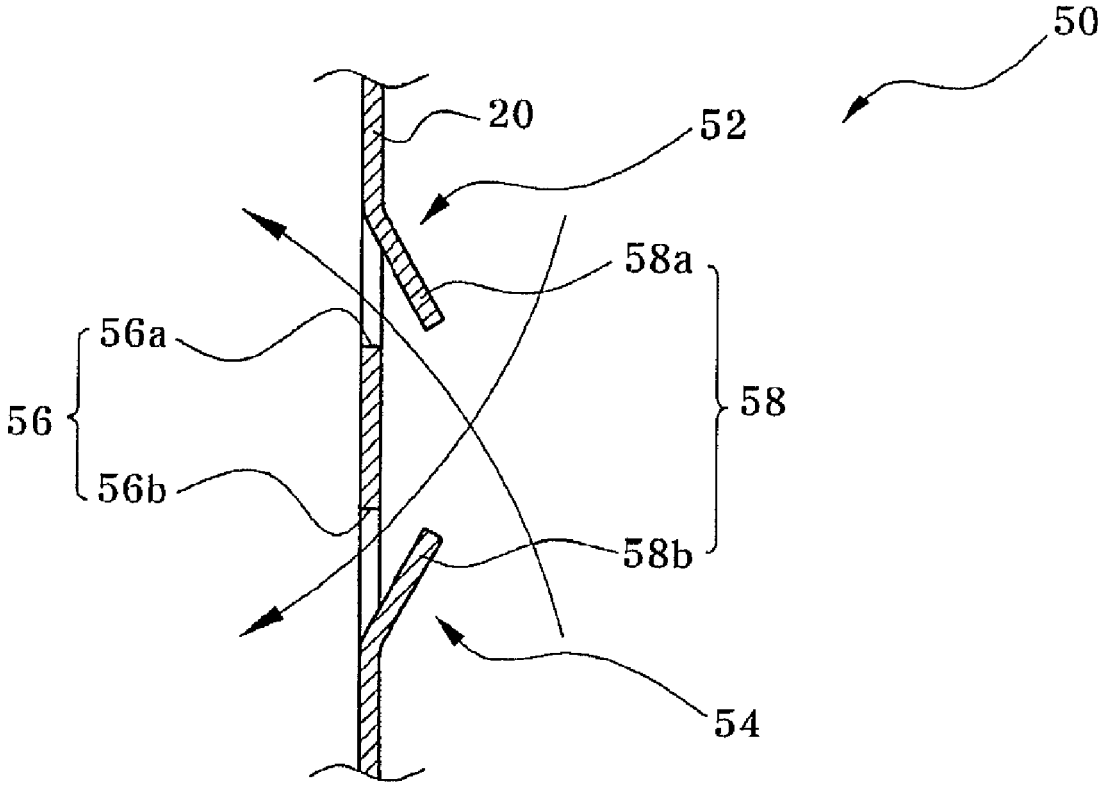
FIG. 6 is a cross-sectional view taken along line A-A of FIG. 5, illustrating a water supply part of the washing machine according to one embodiment of the present invention.
Figure 7:
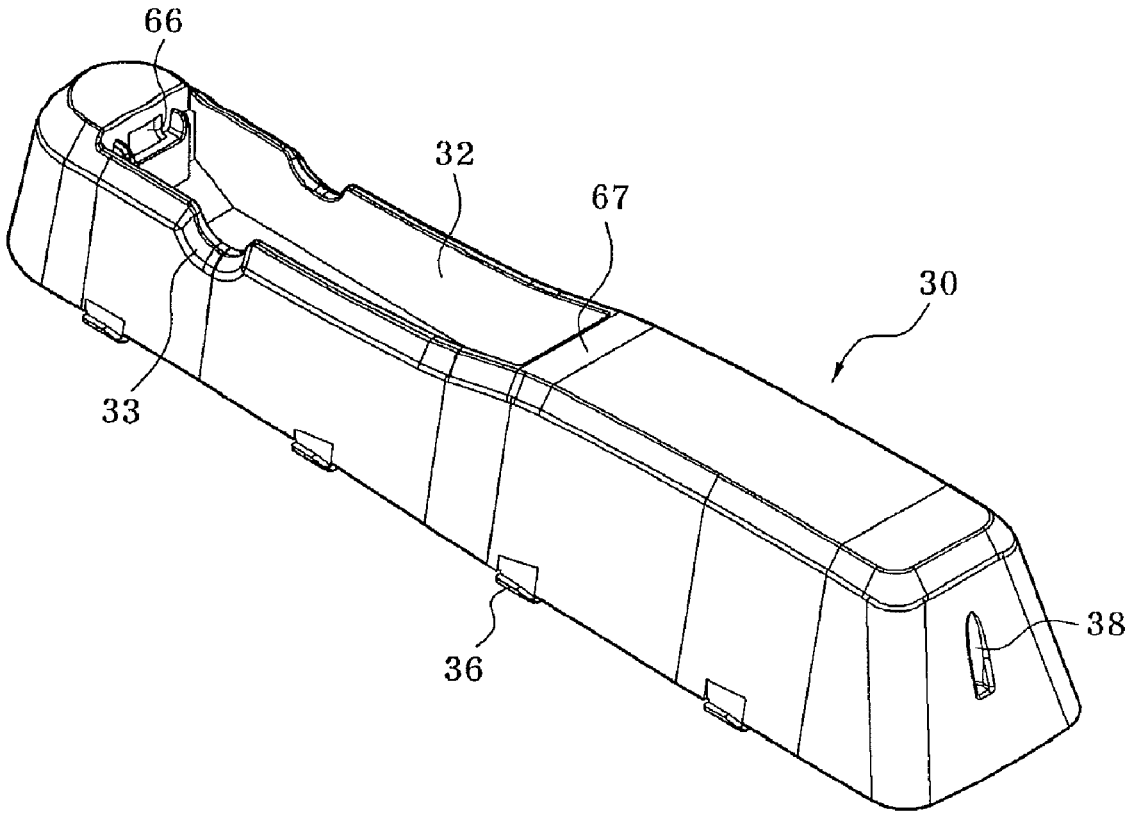
FIG. 7 is a perspective view of a lifter body of the washing machine according to one embodiment of the present invention, shown with the filtering unit removed.
Figure 8:
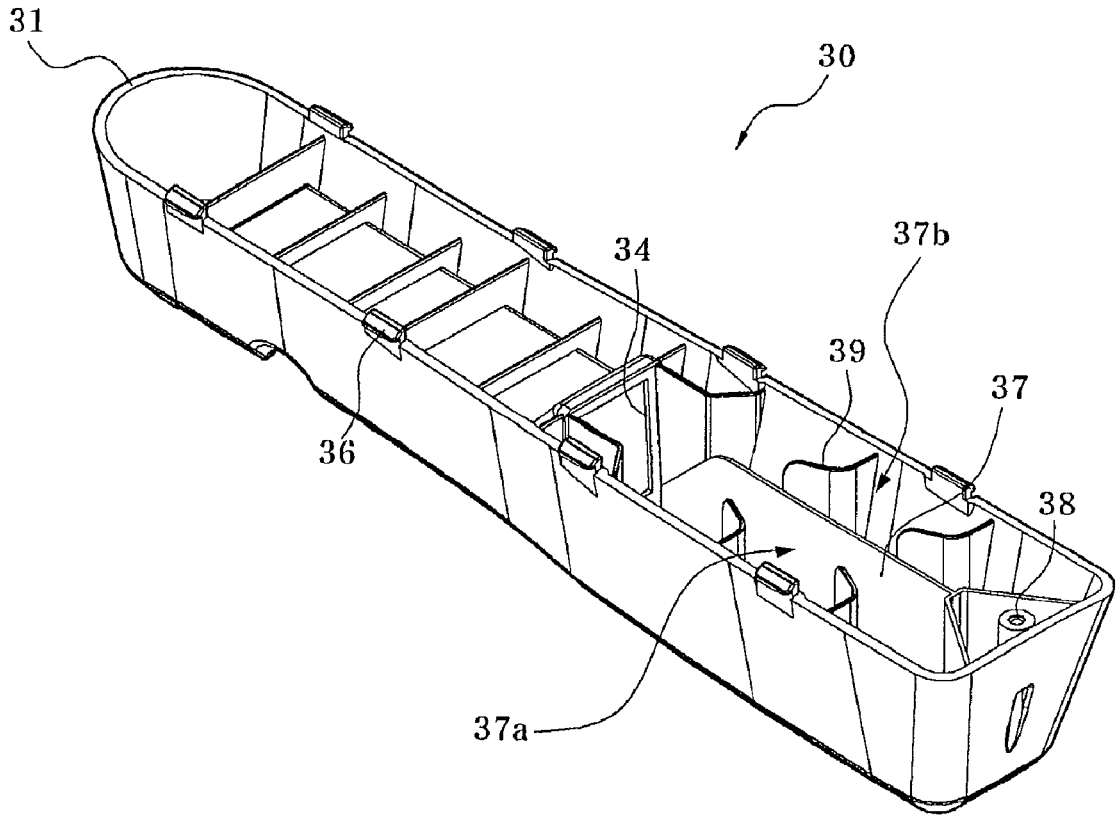
FIG. 8 is a perspective view of the underside of the lifter body of the washing machine according to one embodiment of the present invention.
Figure 9:
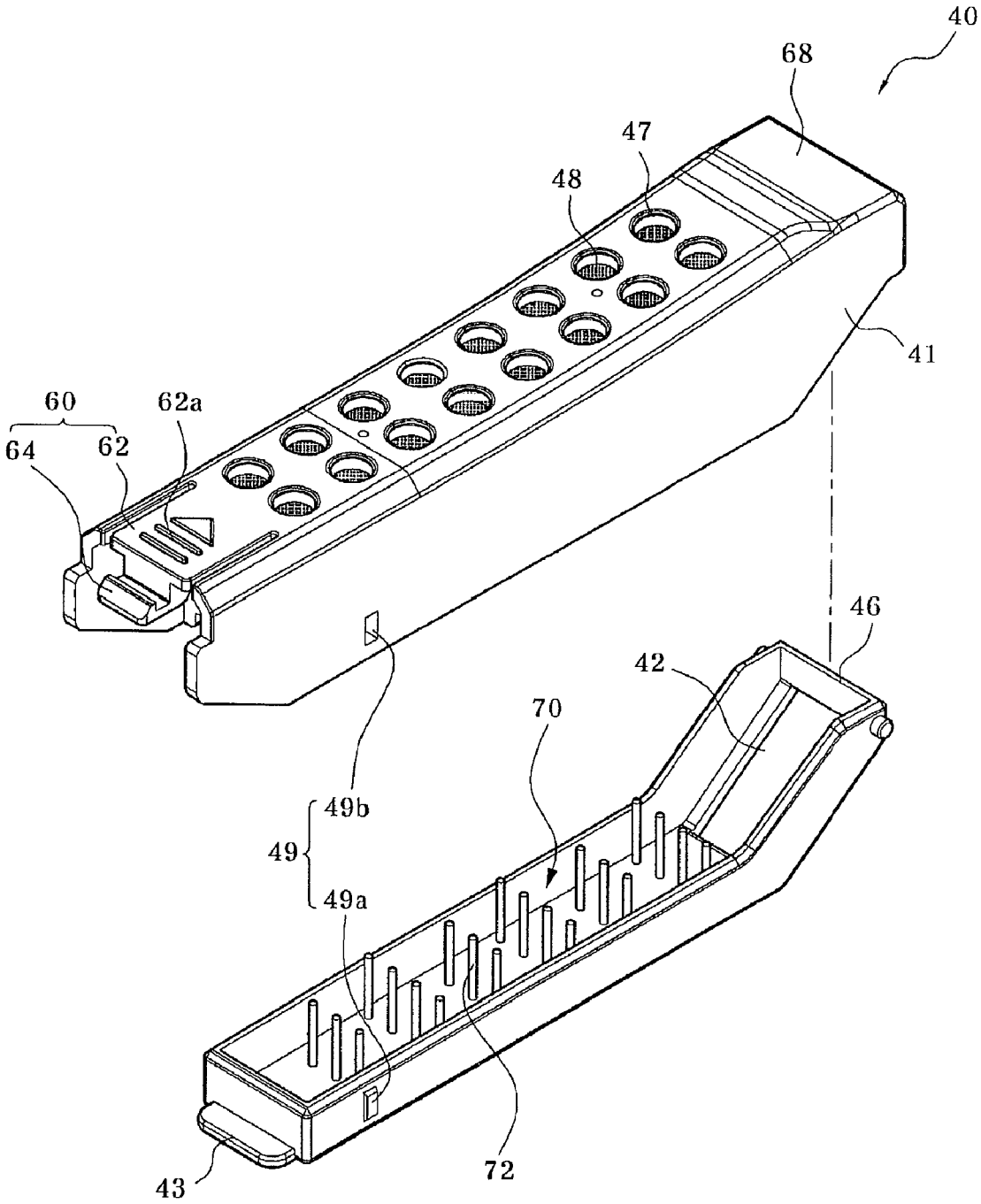
FIG. 9 is an exploded perspective view of a filtering unit of the washing machine according to one embodiment of the present invention.

Referring to FIGS. 2 to 9, the washing machine according to one embodiment of the invention includes a cabinet 10. An opening 12 is formed on a front side of the cabinet 10. The washing machine further includes a tub 14 disposed inside the cabinet 10 arranged to open toward the opening 12 and configured to contain water supplied from the outside, a drum 20 rotatably mounted in the tub 4 and configured to receive laundry, a drive unit 18 connected to a rotational shaft of the drum 20 and mounted behind the tub 14, and a suspension 16 disposed between an inner wall of the cabinet 10 and an outer wall of the tub 14.

The drum 20 includes a plurality of lifters 100 that protrude from an inner wall thereof toward the center of rotation. Each lifter 100 serves to raise and drop laundry as the drum 20 rotates, increasing agitation of the laundry and improving the washing effect of the washing machine.

The drum 20 has latch holes 22 (FIG. 5) formed at locations corresponding to lower ends of opposite sides of a lifter body 30, which receive corresponding securing protrusions 36 intermittently formed on the lower ends of the opposite sides of the lifter body 30. In addition, the drum has a coupling hole 24 to which the lifter body 30 is coupled by a fastening member (not shown).

After fitting the securing protrusions 36 of the lifter body 30 to the corresponding latch holes 22 of the drum 20, a fastening members is fastened to the coupling hole 24 via a fastening hole 38 of the lifter body 30, so that the lifter body 30 is secured to the inner wall of the drum 20.

The lifter 100 includes the lifter body 30 mounted to the inner wall of the drum 20, a filtering unit 40 received in the lifter body 30, and a water supply part 50 provided on the inner wall of the drum 20 to guide water, which is flowing from the tub 14, to an inlet 42 of the filtering unit 40. The filtering unit 40 includes the inlet 42, and a plurality of outlets 47 where a filter 48 is disposed to collect foreign matter. The lifter body 30 may be elongated and the lifter body 30 extends longitudinally in a front-to-rear direction of the washing machine.

The lifter body 30 includes an opened portion 31 (FIG. 8) which confronts an inner surface of the drum 20. The lifter body 30 includes the securing protrusions 36 which are formed at the opened portion 31 and are inserted into the associated latch holes 22. The lifter body 30 also includes the fastening hole 38 formed at the opened portion and aligned with the coupling hole 24 of the drum 20 and secured thereto via a fastener (not shown). Further, the lifter body 30 includes a seating part 32, which is recessed to receive the filtering unit 40. The seating part 32 has a through-hole 34 formed at one side thereof at a location corresponding to that of the inlet 42.

The lifter body 30 includes a partition wall 37 partitioning an inner space thereof at a side corresponding to the water supply part 50, and guides 39 formed on the inner wall of the lifter body 30 between the partition wall 37 and the lifter body 30. Each of the guides 39 has a panel shape that protrudes from either inner wall of the lifter body 30 toward the partition wall 37 and is bent in a curved shape toward the through-hole 34.

Water supplied from the tub 14 into the lifter body 30 via the water supply part 50 is guided into the filtering unit 40 through the inlet 42 via the through-hole 34, and flows into the drum 20 through the outlets 47. At this time, the water flows toward the through-hole 34 along a flow path formed by the partition wall 37. Further, the guide 39 prevents the water from flowing backward, so that turbulence caused by backward flow is suppressed, thereby allowing the water to smoothly flow to the through-hole 34. Water introduced into the filtering unit 40 through the inlet 42 via the through-hole 34 is discharged into the drum 20 via the outlets 47, but foreign matter is filtered out of the water by the filter 48 and remains in the filtering unit 40.

As such, since foreign matter such as fluff and the like is filtered out from water and collected in the filtering unit 40 while water continuously circulates in the drum during a washing operation, after the washing operation a user can separate the filtering unit 40 from the lifter body 30 and remove the foreign matter from the filtering unit 40.

The filtering unit 40 (FIG. 9) includes a case 46 having the inlet 42, a cover 41 hingedly coupled to the case 46 and having the outlets 47, and the filter 48 mounted inside the outlets 47. A locking part 49 is disposed between the case 46 and the cover 41, and serves to maintain the cover 41 in a position overlying the case 46. The filtering unit 40 may be detachably coupled to the lifter body 30.

The inlet 42 is formed on a back portion of the case 46, which is opened at one side and inclined at a predetermined angle. The case 46 has a protrusion 43 extending forwardly from a front portion of the case 46, on which one end of the cover 41 is seated.

The cover 41 is assembled to the seating part 32 of the lifter body 30. The cover 41 is opened at one side and hingedly coupled to the case 46. The cover 41 includes a mounting part 60. The cover 41 is formed at one side with the outlets 47, and the filter 48 is mounted to an interior surface of the cover 41 at a location corresponding to the outlets 47. The filter 48 is a screen and is mounted on the inner wall of the cover 41 in an inserted manner. The filter 48 may be made of metal. Accordingly, it is unlikely that there will be a need to replace the filter 48 with new one. In use, a user can easily remove foreign matter from the filtering unit 40 after detaching the filtering unit 40 from the lifter body 30 and opening the cover 41 of the filtering unit.

The locking part 49 includes a pair of locking protrusions 49*a* formed on opposed sides of the case 46, and a pair of locking grooves 49*b* formed on opposed sides of the cover 41 and positioned at a location corresponding to that of the pair of locking protrusions 49*a*. When the cover 41 is rotated to a closed position covering the case 46, as the inner walls of the sides of the cover pass over the locking protrusions 49*a*, both inner walls of the cover 41 are driven apart from each other, the locking protrusions 49*a* slide along the inner walls of the cover 41, and are finally inserted into the corresponding locking grooves 49*b*, whereby the walls of the cover 41 regain their undeformed shape and the case 46 is covered with the cover 41.

Likewise, when a user pulls the cover 41 outward from the case 46, the locking protrusions 49*a* detach from the locking grooves 49*b*, whereby cover 41 is released from the case 46, so that the filtering unit 40 is opened.

The water supply part 50 (FIG. 6) includes a hole 56, which is formed by cutting a portion of the inner wall of the drum 20 at a location corresponding to that of the through-hole 34 and the inlet 42, and a guide panel 58 formed by outwardly bending the cut portion of the inner wall.

Further, the water supply part 50 includes a first water supply part 52 formed by bending the cut portion of the drum 20, and disposed at a location corresponding to that of a first section 37*a* partitioned by the partition wall 37, and a second water supply part 54 formed by bending the cut portion of the drum 20, and disposed at a location corresponding to that of a second section 37*b* partitioned by the partition wall 37.

If the drum 20 rotates in the clockwise direction, water flows into the drum 20 through the first water supply part 52. On the other hand, if the drum 20 rotates in the counterclockwise direction, the water flows into the drum 20 through the second water supply part 54. Accordingly, the water supply part 50 makes the water flow into the drum 20 along a predetermined channel regardless of the rotating direction of the drum 20.

Further, a space within the lifter body 30 at a location corresponding to the location of the first and second water supply parts 52 and 54 is partitioned by the partition wall 37, so that the water flows smoothly through the respective first and second water supply parts 52 and 54 without any interference with each other.

The mounting part 60 of the cover 41 is disposed between the seating part 32 and the filtering unit 40 such that the filtering unit 40 can be mounted to or detached from the seating part 32 by manipulation of the user.

The mounting part 60 (FIG. 4) includes an elastic portion 62 formed at a front end of the cover 41 and having a pair of slits spaced at a predetermined distance from each other, a hook 64 projecting from the elastic portion 62, and a securing hole 66 formed in the seating part 32 corresponding to the hook 64 to hold the hook 62 when it has been slidably inserted into the securing hole 66. The mounting part 60 also includes a latch jaw 67 formed on the seating part 32 in the vicinity of the through hole 34, an extended portion 68 extending outwardly from a rear end of the cover 41 to correspond to the latch jaw 67 and disposed inside the latch jaw 67, and a stopper 69 formed on the inner wall of the seating part 32 at a location corresponding to that of an end face of the extended portion 68 and spaced a predetermined distance from the extended portion 68 to allow the filtering unit 40 to slide into the seating part 32.

When inserting the filtering unit 40 into the lifter body 30, the extended portion 68 is tilted at a predetermined angle and then inserted into the latch jaw 67 of the seating part 32. Then, with the filtering unit 40 inserted into the seating part 32, the filtering unit 40 is slid toward the front side of the lifter body 30, and the elastic portion 62 is then moved downward to insert the hook 64 into the securing hole 66, so that the filtering unit is inserted into the lifter body 30.

When detaching the filtering unit 40 from the lifter body 30, the filtering unit 40 is slid into the seating part 32 while pushing the elastic portion 62 to release the hook 64 from the securing hole 66, so that the front end part of the filtering unit 40 is raised, allowing the filtering unit 40 to be detached from the lifter body 30.

To smoothly perform the mounting and detachment of the filtering unit 40, a plurality of ribs 62*a* are formed on an upper surface of the elastic portion 62 which facilitate the sliding operation of the filtering unit 40. Further, a pair of grooves 33 is formed in upper ends of opposed sides of the seating part 32 that permit a user's fingers to grasp the cover 41 such that the filtering unit 40 can be easily raised by the user.

Further, the filtering unit 40 includes a latch part 70 to collect foreign matter from water flowing through the inlet 42. The foreign matter introduced into the filtering unit 40 is primarily filtered by the latch part 70, and secondarily filtered by the filter 48, thereby effectively removing the foreign matter from water. The latch part 70 includes a plurality of protrusions 72 formed on a bottom surface of the case 46 and arranged at predetermined intervals, so that the foreign matter introduced through the inlet 42 and flowing toward the outlet 47 is caught by the protrusions 72.

Next, operation of the lifter of the washing machine according to the embodiment of the present invention will be described.

First, a user manipulates the drive unit 18 to rotate the drum 20 and start the washing operation. When the drum 20 rotates, water is introduced from the tub 14 into the lifter body 30 via the water supply part 50. At this point, if the drum 20 rotates in the clockwise direction by a control program, the water is introduced into the lifter body 30 through the first water supply part 52. On the other hand, if the drum 20 rotates in the counterclockwise direction, the water is introduced into the lifter body 30 through the second water supply part 54. The water introduced through the first and second water supply parts 52 and 54 flow into different spaces partitioned by the partition wall 37, and thus are prevented from interfering with each other. Furthermore, the guides 39 prevent the water from flowing backward, so that the water can be smoothly circulated in the washing machine. As described above, the introduced water flows into the filtering unit 40 through the inlet 42 via the through-hole 34, and is then discharged into the drum 20 via the outlet 47. At this time, foreign matter contained in the water is primarily caught while passing through the latch part 70, and secondarily caught by the filter 48 mounted inside the outlet 47 to remain within the filtering unit 40. Accordingly, water can be supplied to the drum 20 without any foreign matter, so that washing operation can be cleanly performed. If the washing operation continues for a predetermined time or more, circulation of the water is repeated so that the foreign matter contained in the water can be effectively removed therefrom. After the washing operation, the hook 64 is released from the securing hole 66 by sliding the filtering unit 40 into the seating part 32 while pushing the elastic portion 62. Then, the filtering unit 40 is further slid until the extended portion 68 contacts the stopper 69, and is gripped by the user through the grooves 33 of the seating part 32. Thus, the filtering unit 40 can be easily separated from the lifter body 30. Further, when the cover 41 is rotated around the hinge, the locking protrusions 49*a* are released from the locking grooves 49*b* and the filtering unit 40 is opened, so that the user can remove foreign matter accumulated in the filtering unit 40. With the aforementioned operation, foreign matter such as fluff and the like from the laundry can be collected in the filtering unit 40 and the filtering unit 40 can be easily detachable, so that the washing operation can be cleanly and easily performed and so that the foreign matter can be readily removed.

As apparent from the above description, the washing machine according to the present invention is formed with a flow path, along which water is introduced from a tub into a drum through a lifter, and to which a filtering unit is mounted to collect foreign matter, so that the foreign matter can be effectively removed during washing operation, thereby enabling effective washing operation.

Additionally, in the washing machine according to the present invention, the lifter is fitted into the drum and fastened thereto by a fastening member, so that it can be easily mounted to the drum.

Further, in the washing machine according to the present invention, the lifter is connected to a water supply part, so that water can flow only into the drum through the lifter irrespective of rotating directions of the drum, thereby allowing easy collection of foreign matter. Further, the lifter includes guides to prevent water introduced into a filtering unit from flowing backward, so that the foreign matter filtered by the filtering unit can be prevented from being discharged again into the drum.

Moreover, in the washing machine according to the present invention, the filtering unit includes a latch part in addition to a filter, so that foreign matter introduced into the filtering unit can be filtered twice, that is, once by each the latch part and the filter, thereby enabling effective removal of the foreign matter.

Although the present invention has been described with reference to the embodiments and drawings, the embodiments and drawings are given by way of illustration only, and, it will be apparent to those skilled in the art that various modifications and equivalent embodiments can be made without departing from the scope of the present invention. Further, although the present invention has been described based on the drum type washing machine, the drum type washing machine is given by way of illustration only, and the lifter of the present invention can be naturally applied to other types of washing machine. Therefore, the scope of the present invention should be limited only by the accompanying claims.

What is claimed is:

1. A washing machine comprising:

a tub configured to contain water;

a drum disposed inside the tub;

a lifter body mounted to the drum;

a filtering unit disposed in the lifter body which collects foreign matter; and a water supply part which guides water from the tub to the filtering unit, wherein the lifter body comprises a recessed seating part on which the filtering unit is seated, the seating part having a through-hole which permits water to be introduced into the recess, the lifter body further comprises a partition wall dividing an interior thereof, the lifter body further comprises a guide disposed between an inner wall of the lifter body and the partition wall, the guide protrudes from the inner wall of the lifter body toward the partition wall and is bent in a curved shape to extend toward the through-hole.

2. The washing machine according to claim 1, wherein the water supply part comprises:

a hole formed in the drum at a location corresponding to location of the through- hole; and a guide panel formed in the drum along the hole so as to obliquely extend from the hole toward an outside of the drum, wherein the water supply part includes:

a first water supply part formed by bending a cut portion of the drum, and disposed at a location corresponding to that of a first section bounded in part by the partition wall; and a second water supply part formed by bending another cut portion of the drum, and disposed at a location corresponding to that of a second section partitioned apart from the first section by the partition wall.

3. The washing machine according to claim 2, wherein the water supply part comprises a hole, and a guide panel obliquely extending from the hole.

4. The washing machine according to claim 2, wherein the filtering unit further comprises a latch part which collects foreign matter.

5. The washing machine according to claim 4, wherein the filtering unit comprises:

a case having an inlet;

a cover hingedly coupled to the case and having an outlet;

a filter mounted inside the outlet; and a locking part disposed between the case and the cover configured to detachably secure the cover to the case.

6. The washing machine according to claim 5, wherein the latch part comprises a protrusion on the case.

7. The washing machine according to claim 2, wherein the filtering unit is detachably mounted to the lifter body.

8. The washing machine according to claim 2, wherein the filtering unit comprises:

a primary filtering portion; and a secondary filtering portion which filters independently of the primary filtering portion, wherein water introduced into the filtering unit is filtered by both the primary filtering portion and the secondary filtering portion.

9. The washing machine according to claim 8 wherein the primary filter portion comprises a plurality of protrusions arranged at intervals on a surface of the filtering unit.

10. The washing machine according to claim 8 wherein the secondary filter portion comprises a screen filter.

* * * * *